United States Patent [19]

Madlener

[11] 4,174,665

[45] Nov. 20, 1979

[54] LAND MINE CONSTRUCTION PARTICULARLY AN ANTIPERSONNEL SPLINTER MINE

[75] Inventor: Paul Madlener, Karlsruhe, Fed. Rep. of Germany

[73] Assignee: Industrie-Werke Karlsruhe Augsburg Aktiengesellschaft, Fed. Rep. of Germany

[21] Appl. No.: 818,757

[22] Filed: Jul. 25, 1977

[30] Foreign Application Priority Data

Jul. 23, 1976 [DE] Fed. Rep. of Germany ..... 2623163

[51] Int. Cl.[2] ..... F42B 23/16

[52] U.S. Cl. ..... 102/8; 102/67

[58] Field of Search ..... 102/8, 19, 67, 22

[56] References Cited

U.S. PATENT DOCUMENTS

| | | | |
|---|---|---|---|
| 2,926,604 | 3/1960 | MacLeod | 102/22 |
| 3,175,489 | 3/1965 | Reed, Jr. | 102/8 |
| 3,344,742 | 10/1967 | Schneider, Jr. | 102/8 |
| 3,815,504 | 6/1974 | Tieben | 102/67 |
| 3,868,905 | 3/1975 | Ragailler | 102/8 |
| 3,882,779 | 5/1975 | Frostig | 102/67 |
| 4,016,816 | 4/1977 | Larsson et al. | 102/67 |

*Primary Examiner*—Charles T. Jordan

*Attorney, Agent, or Firm*—McGlew and Tuttle

[57] ABSTRACT

A land mine comprises a mine body having at least a ground facing portion with a casing formed of a surface of revolution and having a multiplicity of projectile splinters arranged therearound in a pattern of enveloping tangents, the normals of which point each splinter to a definite target area to be covered. The mine includes an explosive in the casing which is effective upon explosion to catapult the splinters downwardly in a substantially conical distribution each at a predetermined angle depending on the mass of the splinters relative to the mass of the explosive and also depending on the angle of impact of the detonation produced by the explosion on the individual splinters.

11 Claims, 3 Drawing Figures

Igniting charge
Mi
Sp
S
M
D
20
22
24
0
$N_1$
$N_2$
$N_3$
$N_4$
$\alpha_1$
$\alpha_2$
$\alpha_3$
$\alpha_4$
$(\varphi+\delta)_1$
$(\varphi+\delta)_2$
$(\varphi+\delta)_3$
$(\varphi+\delta)_4$
$\alpha_4-(\varphi+\delta)_4$
$X_0$
$X_1$
$X_2$
$X_3$
$X_4$
aqm
bqm
cqm
dqm

LAND MINE CONSTRUCTION PARTICULARLY AN ANTIPERSONNEL SPLINTER MINE

BACKGROUND OF THE INVENTION

1. Field of the Invention

The present invention relates to a land mine, and particularly to an antipersonnel splinter mine, comprising a mine case which contains a plurality of pre-produced splinters and which is to be thrown upwardly by means of an ejecting charge and brought to explosion, at a predetermined level, in a pyrotechnical, mechanical, or electrical way, and in which the splinters are supported on, or, when breaking lines are provided, constitute themselves, the inner shell of the mine case.

2. Description of the Prior Art

Antipersonnel splinter means are known per se for a long time. Up to the present, with such mines, a substantially horizontal effect of the splinters has been desired, primarily for fighting attacking troops. For this purpose, splinter mines of the prior art contain a plurality of heavy splinters, since such splinters ensure a wide radius of action.

Because not only concepts of defensive strategy, but also tactics, particularly combat tactics, are undergoing changes, what is now required is an antipersonnel splinter mine having an only limited radius of action, for example of 20 meters, and having no effect beyond a certain distance, for example of 50 meters. Such mines can be planted at a relatively small distance from the force's lines or in front of other objects to be protected, without endangering the force's troops. Due to their limited radius of action, mines of this kind are excellently suitable also for territorial home defense, for example, for protecting and securing vital objects, such as power stations, transformer stations, dams, airports, depots, or the like. In addition, antipersonnel splinter mines, if used zonally, are suitable for fighting individually not detactable targets of covert warfare, for example, sabotage troops. An antipersonnel mine may be set off in various ways, depending on the application, for example, by means of span-wires or tread fuses, or also by electrical remote control.

German Offenlegungsschrift No. 2 300 230 (U.S. Pat. No. 3,868,905) provides a bounding mine comprising a mine body which can be fragmented into splinters by a detonating explosive charge. According to this disclosure, the lower portion of the mine body is arched downwardly thus substantially of hemispherical shape. This hemispherical portion is joined to an upper portion which is either cylindrical or conical or frustoconical.

With such a design of the mine body, an improved effect of the splinters is intended, particularly an improved spray effect markedly directed toward the ground, thus with a component of the splinter distribution which is directed "to a considerable extent" downwardly. A further intention of this design is to largely prevent irregularities in the effect of the splinters.

Even though this prior art U.S. Pat. No. 3,868,905 is right in realizing that the splinter effect, as well as the spray effect, largely depends on the geometry of the mine body; the provided solution is by no means suitable for actually coming to the goal aimed at.

SUMMARY OF THE INVENTION

Starting from the theoretical work by Held based on extensive experiments (Separate print "Splitterballistik"/ Splinter ballistics/ by Dr. M. Held, from Nos. 12/1967, 3/1968, and 4/1978 of the periodical "EXPLOSIVSTOFFE", published by Erwin Barth Verlag KG, Mannheim.) and taking into account the variety of possible applications of antipersonnel splinter mines, but also starting from the unsatisfactorily designed mine body of the cited German OS 2 300 230 (U.S. Pat. No. 3,868,905), the present invention is directed to an antipersonnel splinter mine actually ensuring an as uniform as possible splinter distribution within a definite range of action, for example, one fatal hit per square meter.

In accordance with the invention, it is provided that the shape of the mine case, or, at least, of the inner shell thereof located between the explosive and the splinters, is defined by a system of enveloping tangents having their normals pointed each to a definite target area to be covered with hitting splinters which, at the explosion, are catapulted downwardly in conical distribution, with the angle of departure of the splinters being corrected, first by an angle ($\phi$) depending on the ratio of the mass of the splinter charge to the mass of the explosive, and, second, by an angle ($\alpha$) depending on the angle of impact of the detonation front on the splinters.

On the basis of this idea underlying the invention, the target area covered by a certain splinter charge can largely be predetermined. Therefore, the number of the splinters provided in the structure must be sufficiently large to securely obtain the required splinter density in the defined target areas. In this way, the mine body can be calculated and designed piece by piece.

The number of the splinter layers adjacent the explosive cannot be increased arbitrarily. In addition, since the geometric dimensions of the mines, as a rule, are substantially fixed, a maximum size of the splinters is, in fact, predetermined. On the other hand, the minimum size of the splinters must not be too small, since with the decreasing size of the splinters the velocity of departure must increase correspondingly.

There is a definite penetration required from the catapulted splinters at different distances of action. This penetration depends substantially on the mass of the individual fragments and on the velocity thereof which, in turn, results from the initial velocity and the geometric dimensions of the fragments. The initial velocity, in its turn, depends, inter alia, on the results of the splinter mass to the explosive mass as well as on the duration of the explosion gas pressure, in accordance with the theorem of momentum $P \cdot dt = m \cdot dv$.

According to a development of the inventive idea, the duration dt of the gas pressure P may be extended by making the mine body, or its shell, at least in the zone between the explosive charge and the splinter carrier, of a tough material, such as sheet metal for cold deep drawing, or Al Mg Si 0.5, soft-annealed.

Usually, loosely filled splinters in splinter mines are held assembled by a thin outer shell. The use of such an outer shell, however, involves the risk that upon explosion of the mine, undesirable splinter packs are formed which very unfavorable influence the distribution of the fragments. It is therefore advantageous to embed the splinters in plastic or, in accordance with a further feature of the invention, with a loose accommodation of the splinters, to envelope them with a shell of brittle material, such as bakelite or the like, which is disintegrated by the explosion into small fragments.

In order to prevent an uncontrollable ignition of the explosion gases, the invention further provides that either the explosive is cast into the inner shell, or, if a compressed block of explosive is provided, this block is gastightly glued into the splinter support.

If the explosive charge is flush with the uppermost splinter layer, upon the detonation, the splinter layers will deviate upwardly, because of the absence of a pressure damming, with the result of undesirable elevated hits which, in addition, are then missed in the number of fragments for effective coverage. Such drawbacks are substantially avoided, in accordance with a further features of the invention, by providing a layer of explosive of satisfactory thickness which covers the splinter charge at the front side as far as possible and which comprises an explosive having a higher velocity of detonation than the explosive charge proper of the mine, thus of the kind of a priming charge.

Theoretically, the point of ignition of the explosive charge is to be as high as possible, to obtain a long starting distance. This makes the detonation front substantially planar as it reaches the splinters. In the extreme case, the result is a so-called skirting front, relative to the splinter layer. Mostly, this is constructionally not possible, so that the splinters are not catapulted at the angle already mentioned above, which is a function of the starting angle phi ($\phi$). Another way could be, for example, to insert the priming charge as a central tube. This would lead to a striking detonation front, relative to the splinter layer, by which the splinters would be catapulted perpendicularly to the explosive boundary. But even with this design, which is still within the scope of the invention, an overlapping explosive cover on the front side of the splinter space must be maintained.

It is easily understandable that the provided anti-personnel splinter mine offers numerous advantages of which the relatively simple construction, the conical splinter dispersion, and the intentionally narrowly limited range of action are to be noted, for example.

Accordingly it is an object of the invention to provide a land mine which comprises a mine body which has a portion of a casing formed with a surface of revolution and including a multiplicity of projectile splinters arranged therearound in a pattern of enveloping tangents, the normals of which point each splinter to a definite target area to be covered and wherein an explosive is arranged in the casing which is effective upon explosion to catapult the splinters downwardly in a substantially conical distribution each at a predetermined angle which depends on the mass of the splinter to the mass of the explosive and also depends on the angle of impact of the detonation front of the explosion on the individual splinters.

A further object of the invention is to provide a land mine which includes splinters or projectile elements formed on a casing which are arranged to provide selected distribution of the projectiles so as to obtain a maximum hit in selected target areas.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF PREFERRED EMBODIMENT

Figure 1:
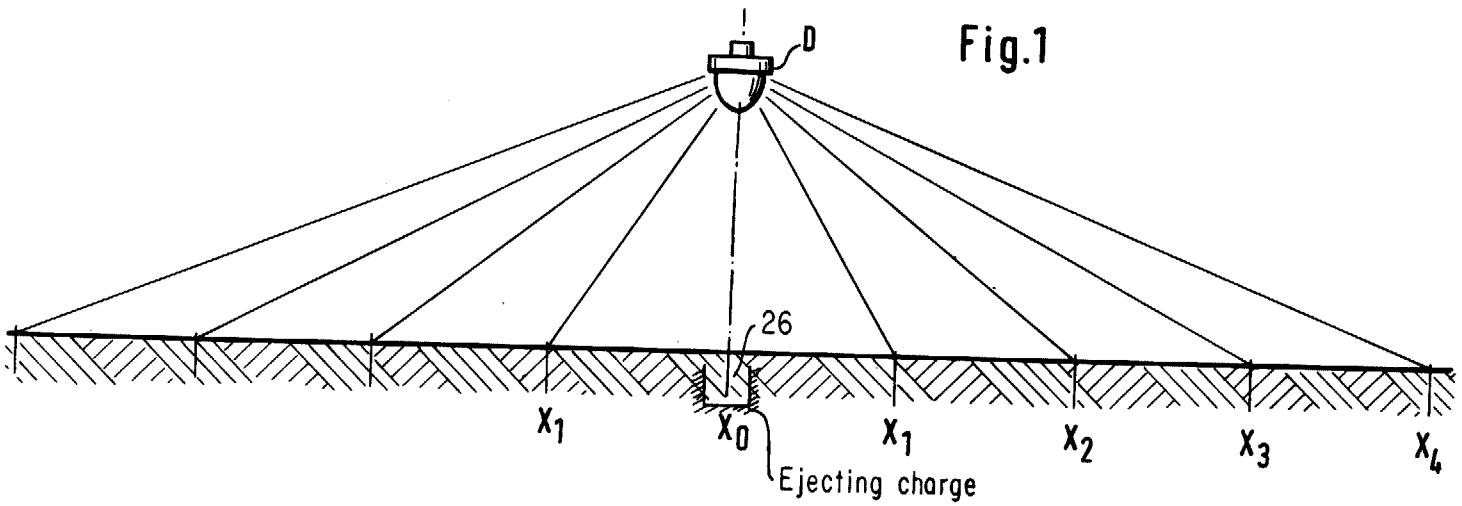
FIG. 1 is a diagram illustrating the conical explosion of a splinter mine with the precalculated splinter directions being shown.

Referring to the drawings in particular, the invention embodied therein comprises a land mine which includes a mine body M having at least a ground facing portion with a casing Mi which is formed of a surface of revolution and has a multiplicity of projectile splinters Sp arranged thereon either as a separate wall formation or as part of a wall formation with an inner shell part Mi. The mine body M includes an igniting charge 20 having a central part disposed over a central tubular portion 22 having a primer charge 24 therein.

In FIG. 1, above the point $X_0$ of the x-axis, the detonation point D above ejecting charge 26 of an antipersonnel splinter mine is plotted. The straight lines conically issuing from the point D and intersecting the x-axis at points $X_0 \ldots X_4$ indicate the directions followed by the splinters upon explosion.

Figures 2, 3:
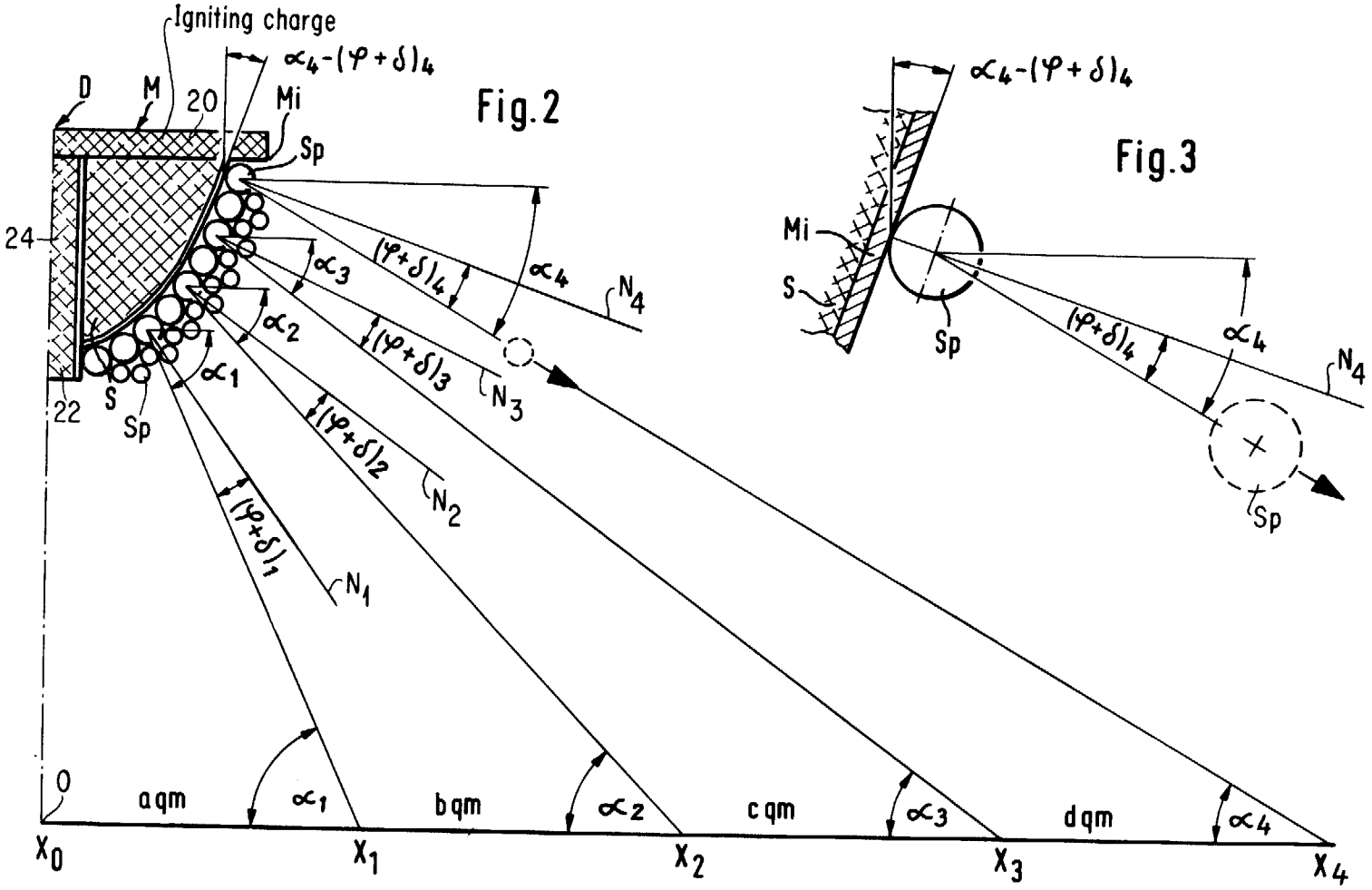
FIG. 2 is a view similar to FIG. 1 showing in addition the inner shell of the mine body, the shape of which is defined by a system of enveloping tangents.
FIG. 3 is an enlarged detail view of FIG. 2.

FIG. 1 is developed in FIG. 2 where one half of a mine body M containing an explosive S is shown above point 0 of the x-axis, at the level of detonation point D. Between explosive S and the splinters Sp, an inner shell Mi is provided. The shape of this shell is defined by a system of enveloping tangents the normals $N_0 \ldots N_4$ of which point to the vicinity of the target area. The inner shell Mi may be thought of as a plurality of thin conical or polygonal rings connected to each other, with ever increasing angles of inclination. Each ring is an enveloping tangent portion inclined at the definite angle wanted.

The effective angle of departure of the splinters in the vertical follows from taking into account the correction which is equal to the sum of angles ($\phi+\delta$). Angle ($\phi$) phi depends on the ratio of the mass of the splinter charge to the mass of the explosive and angle ($\delta$) delta depends on the angle of impact of the detonation front on the splinters.

Splinters or ball fragments Sp are arranged in circumferential rows (one of which is shown) as part of a casing in a pattern of enveloping tangents which have normals which point each splinter to a definite target area to be covered. The explosive S in the mine is effective upon explosion to catapult the splinters downwardly in a substantially conical distribution each at a predetermined angle ($\phi$) phi depending on the mass of the splinter charge to the mass of the explosive and also by an angle ($\delta$) delta depending upon the angle of impact of the detonation of the front of the splinters.

Although inner shell Mi is shown of thin material with splinters Sp thereon, the shell itself can be made of thick material and be divisable by the explosion, to form the splinters itself. In either case, the structure for forming the splinters can be thought of as projectile spliner forming means.

While a specific embodiment of the invention has been shown and described in detail to illustrate the application of the principles of the invention, it will be understood that the invention may be embodied otherwise without departing from such principles.

What is claimed is:

1. A land mine comprising a mine body having at least a ground facing portion with a casing formed of a surface of revolution, said surface of revolution having a multiplicity of projectile splinter forming means arranged in a plurality of enveloping tangent portions, the normals of each tangent portion pointing each splinter forming means to a definite target area to be covered, and an explosive in said casing effective upon explosion to catapult the multiplicity of splinter forming means downwardly in a substantially conical distribution, each at a predetermined angle depending on the mass of said splinter to the mass of said explosive and depending on the angle of impact of the detonation front of the explosion of the individual splinter.

2. A land mine according to claim 1 wherein said splinter forming means comprises said casing including an inner casing forming a splinter support, and splinters supported on said support in from one to at most three layers.

3. A land mine according to claim 1, wherein said casing includes an inner shell portion of a tough material such as sheet metal for cold deep drawing or Al Mg Si 0.5, soft-annealed.

4. A land mine according to claim 1, wherein said casing includes an inner shell, said plurality of splinter forming means being held together by said shell, said shell being made of a brittle material.

5. A land mind according to claim 1, wherein the explosive comprises a cast explosive formed in said casing.

6. A land mind according to claim 1, wherein said explosive comprises a compressed block, and means for adhesively securing said block to said casing.

7. A land mine according to claim 1, including a covering of a layer of explosive of definite thickness over said splinter forming means.

8. A land mine according to claim 7, wherein said coating of explosive on said splinter forming means has a higher velocity of detonation than said explosive in said casing.

9. A land mine according to claim 1, including a central tubular portion of said mine body and a priming charge in said central tubular portion.

10. A land mine according to claim 1, including an igniting charge arranged on the top of said mine body.

11. A land mine, particularly an antipersonnel splinter mine, comprising a mine case, an explosive in said case, said case having an inner shell including a plurality of pre-produced splinters, said mine being adapted to be thrown upwardly by means of an ejecting charge and brought to an explosion by emission of the explosive in said case at a predetermined level and by a selected mechanical, pyrotechnical and electrical way, said mine case including an inner shell portion located between the explosive and the splinters formed of a plurality of enveloping tangent portions defining launching surfaces for the splinters which determine the direction of the splinters and the start of the splinters outwardly from said shell portion, the normals of said launching surfaces pointing each splinter to a definite target area to be covered with hits of the splinters, said explosive being effective upon explosion to catapult the splinters downwardly in a conical distribution, with however, the angle of departure of the splinters being changed to the effect of a correction, first by an angle phi ($\phi$) depending on the ratio of the mass of the splinter charge to the mass of the explosive and, second, by an angle delta ($\delta$) depending on the angle of impact of the detonation front of the splinters.

* * * * *